United States Patent [19]

Robinson et al.

[11] 3,947,899

[45] Apr. 6, 1976

[54] WARM WATER SUPPLY KIT

[76] Inventors: Joseph D. Robinson, 1209 W. 159th St., Gardena, Calif. 90247; Joseph Fleming, 15925 McDermitt St., Fountain Valley, Calif. 92708

[22] Filed: Aug. 22, 1974

[21] Appl. No.: 499,656

[52] U.S. Cl. ..... 4/7; 4/6

[51] Int. Cl.[2] ..... A47K 11/08; A47K 3/22

[58] Field of Search ..... 4/6, 7, 97, 182, 192; 137/613

[56] References Cited

UNITED STATES PATENTS 2,875,450 3/1959 Umann ..... 4/7

3,462,766 8/1969 Merkel, Jr. ..... 4/7

*Primary Examiner*—Houston S. Bell, Jr.
*Assistant Examiner*—Larry Jones
*Attorney, Agent, or Firm*—Lyon & Lyon

[57] ABSTRACT

A kit for supplying a small quantity of temperature and pressure controlled warm water for application to body cavities, the kit containing a pressure regulating valve, an anti-syphon valve, a heater and pneumatic operated control switch, the heater maintaining an initial quantity of water in a warm state between operations.

1 Claim, 12 Drawing Figures

SOLENOID
SWITCH
THERMOSTAT
110V.A.C.

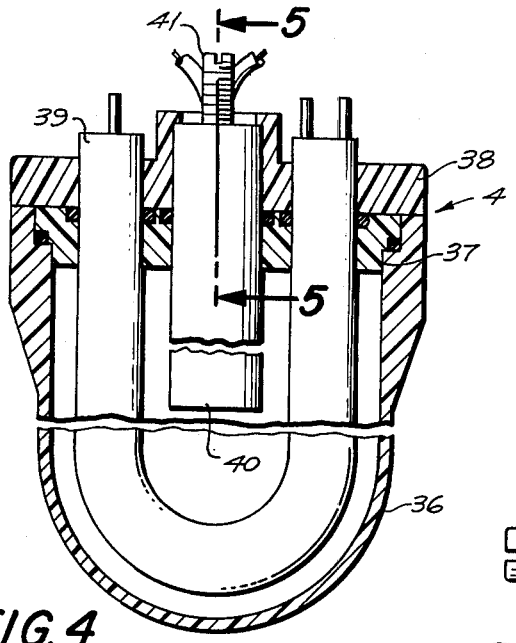
FIG. 4
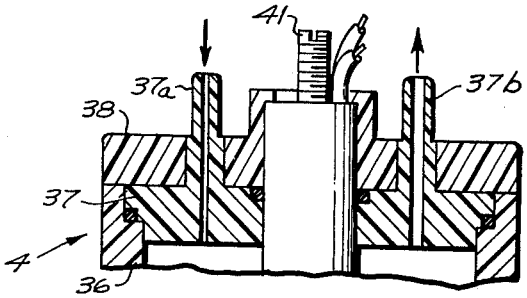
FIG. 5
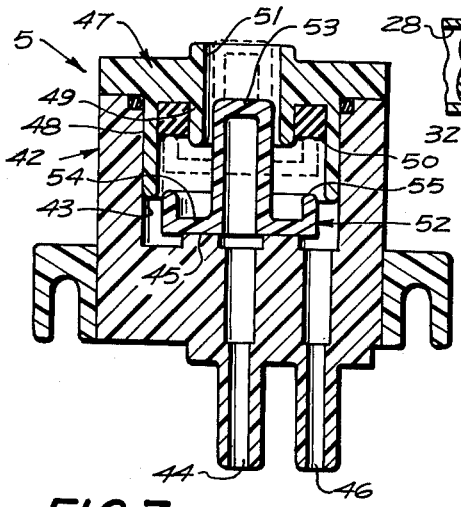
FIG. 7
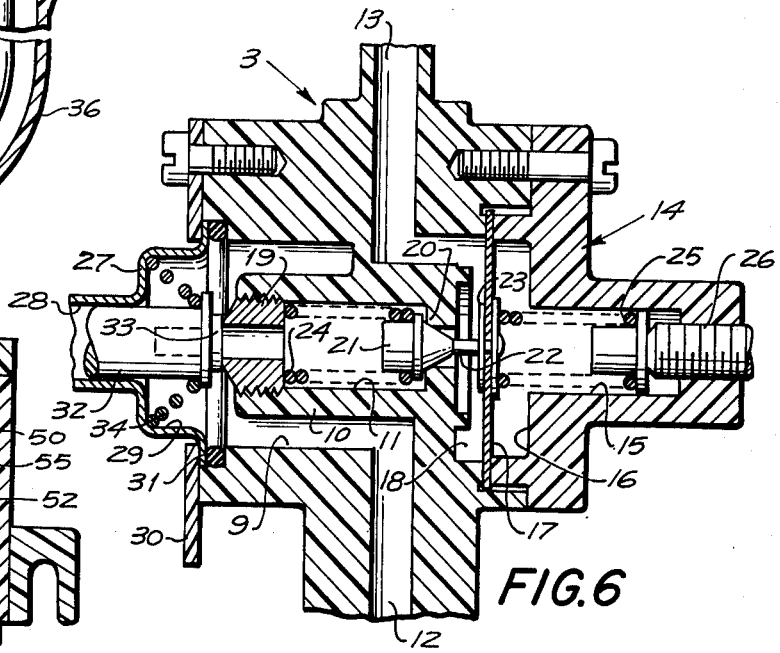
FIG. 6
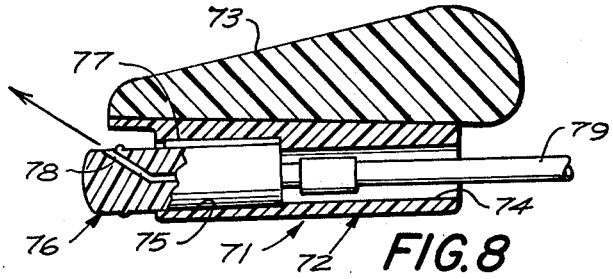
FIG. 8
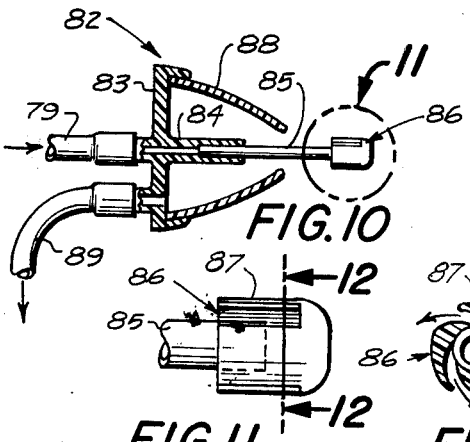
FIG. 10
FIG. 11
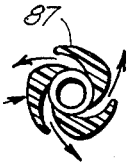
FIG. 12
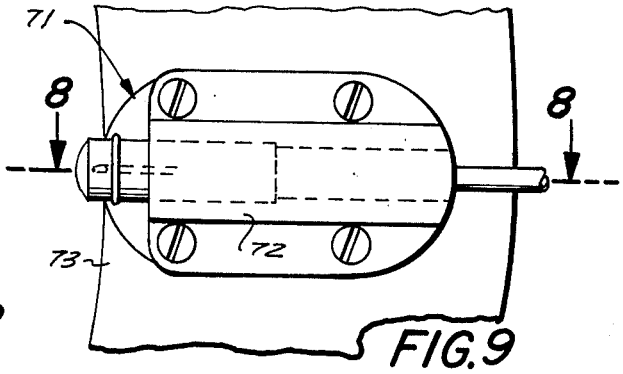
FIG. 9

WARM WATER SUPPLY KIT

BACKGROUND AND SUMMARY OF THE INVENTION

Apparatus incorporated in a toilet seat and arranged to supply warm water to a bidet nozzle is disclosed in U.S. Pat. No. 3,247,524; issued Apr. 26, 1966 for Hygienic Apparatus for Use on Toilet Bowls. This apparatus utilized a valve disclosed in U.S. Pat. No. 3,308,847 issued Mar. 14, 1967 for Solenoid-Operated, Shut-Off and Regulator Valve.

The present invention is directed to an improvement thereon and is summarized in the following objects:

First, to provide a warm water supply kit which need not be incorporated in a toilet seat but may be wall mounted.

Second, to provide a warm water supply kit wherein all electrical elements are enclosed and the control switch is removably actuated by a novely arranged hand or foot operated pneumatic device.

Third, to provide a warm water supply kit which is particularly adapted for connection to a bidet nozzle located under a toilet seat, but which is also adapted for connection to other devices requiring a small quantity of water; for example an ear washing or flushing nozzle.

Fourth, to provide a warm water supply kit which incorporates a novely arranged anti-syphon device to insure against backflow from the discharge nozzle into the water supply line.

DESCRIPTION OF THE FIGURES

FIG. 4 is a fragmentary longitudinal sectional view of the heater.

FIG. 5 is a fragmentary sectional view thereof taken through 5—5 of FIG. 4.

FIG. 6 is an enlarged sectional view of the pressure regulator and shut-off valve with portions shown fragmentarily.

FIG. 7 is a sectional view of the anti-syphon valve.

FIG. 8 is a sectional view of a toilet seat and the bidet nozzle unit taken through 8—8 of FIG. 9.

FIG. 9 is a fragmentary bottom view of a toilet seat with the bidet nozzle unit in position thereon.

FIG. 10 is a longitudinal sectional view of an ear washing device for use with the warm water supply kit with portions in side elevation.

FIG. 11 is a fragmentary enlarged side view thereof taken within circle 11 of FIG. 10.

FIG. 12 is an enlarged sectional view thereof taken through 12—12 of FIG. 11.

Figures 1, 2, 3:
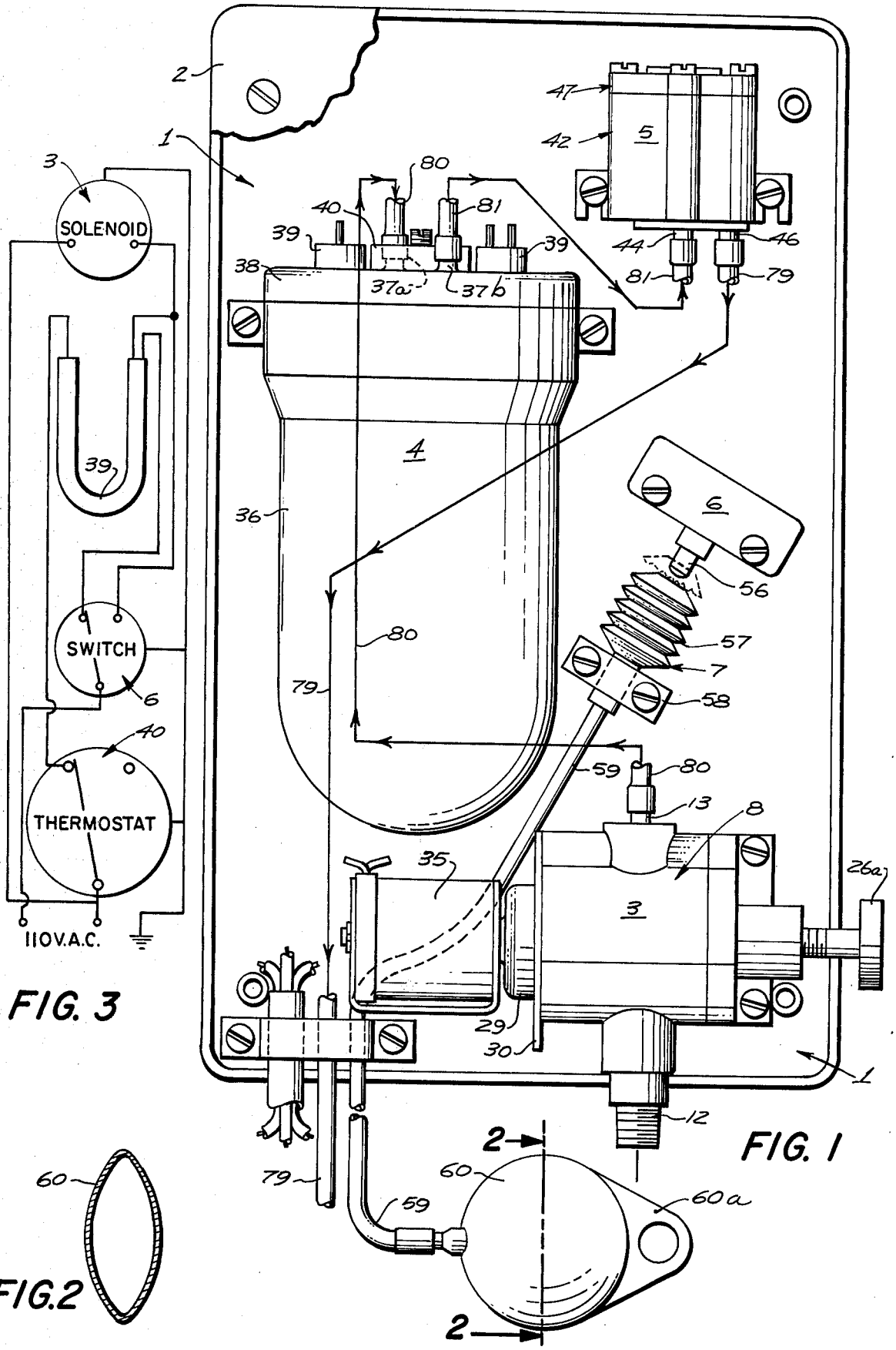
FIG. 1 is a front view of the warm water supply kit as it would appear mounted on a wall and with the cover shown fragmentarily.
FIG. 2 is a sectional view taken through 2—2 of FIG. 1 showing the squeeze bulb.
FIG. 3 is a circuit diagram illustrating the electrical connections between the components of the kit.

The warm water supply kit includes a mounting base 1 adapted to be secured to a wall or suspended by mounting straps over the top edge of a toilet water closet and is provided with a cover 2. Mounted on the base 1, is a pressure regulator and shut-off valve 3, a heater 4 and anti-syphon valve 5, a fluid control switch 6 and a portion of a pneumatic actuator 7.

The internal construction of the pressure regulator and shut-off valve is shown in FIG. 6. The valve includes a body member 8 having an axially disposed annular inlet chamber 9 surrounding a centrally disposed core 10 having an axially extending bore 11. The body member is provided with an inlet 12 communicating with the chamber 9 and one end of the bore 11 and is also provided with an outlet 13 communicating with the opposite end of the bore 11.

Fitted over the body member 8 and suitably secured thereto is a cover member 14 having a regulator spring socket 15 and a recessed end 16. Clamped between the body member 8 and cover member 14 is a diaphram 17 which forms an outlet chamber 18 communicating with the outlet 13.

The bore 11 receives at its end communicating with the chamber 9 a shut-off valve seat ring 19. The opposite end of the bore 11 is constricted to form a regulator valve seat 20. Within the bore and engaging the seat 20 is a regulator valve element 21 having an operating stem 22 engaged by a washer 23 secured at the center of the diaphram 17. Within the bore 11 is a spring 24 urging the valve element 21 toward its seat 20. The force of the spring 24 is opposed by a regulator spring 25 mounted in the socket 15. The regulator spring is adjustable by means of a set screw 26.

Fitted over the chamber 9 is a solenoid armature housing 27 having an armature receiving socket 28 and a belled end 29 terminating in a flange secured in place by a clamp and mounting plate 30. A seal ring 31 is interposed between the flange and the body member 8. A solenoid armature 32 is received in the socket 28 and carries the shut-off valve element 33 which engages the seat ring 19. A spring 34 urges the valve element 33 against its seat. A solenoid unit 35 surrounding the solenoid armature housing 27 is operable in opposition to the spring 34.

The internal construction of the heater 4 is shown in FIGS. 4 and 5. The heater includes a housing 36 which is cylindrical and closed by a hemispherical lower end. The upper or open end of the housing receives a sealing disk 37 and a cap 38. A U-shaped heating unit 39 is fitted within the housing 36 and its ends protrude through the sealing disk 37 and cap 38. The heating unit is conventional and comprises an outer metal tube preferably containing a major heating element and a minor heating element not shown. A conventional thermostat 40 also extends through the sealing disk 37 and cap 38. The thermostat is provided with an adjustment screw 41. An inlet fitting 37*a* and an outlet fitting 37*b* are formed integrally with the sealing disk 37 and protrude through the cap 38. The inlet fitting 37*a* has, preferably, a smaller passage than the outlet fitting 37*b*.

The anti-syphon valve 5 is shown in FIG. 7. The anti-syphon valve includes a body 42 having a cylindrical chamber 43 at the base of which is an inlet 44 centered with respect to the chamber and surrounded by a valve seat 45. An outlet 46 is radially offset from the inlet in parallel relation therewith.

The body 42 receives a cap 47 having annular extensions 48 and 49, the extensions 48 slidably fitting within the chamber 43 and the extension 49 forming with the extension 48 a channel which receives a valve seat ring 50. The annular extension 49 frames a central anti-syphon opening 51 extending through the cap 47.

The chamber 43 receives an anti-syphon plunger 52 having a central tubular stem 53 closed at its upper end and an anti-syphon valve flange 54, the periphery of which is provided with an annular upwardly extending valve seat rim 55. Unless pressure exists at the inlet 44, the valve flange 54 rests on the valve seat 45 as shown by solid lines in FIG. 7. Upon flow of water into the chamber 43 the plunger 52 rises until the rim 55 seats against the value seat ring 50 as indicated by broken lines in FIG. 7. When the plunger is in the solid line position, the inlet 44 is closed and the outlet is exposed to atmosphere by reason of the clearance between the opening 51 and the stem 53.

The flow control switch 6 shown in FIG. 1 is provided with a push button 56 which is engaged by a bellows 57 forming part of the pneumatic actuator 7. The bellows is molded of pliable material and includes a stem which is secured by a clamp 58 in such a manner that the bellows may be extended and contracted for engagement and release of the push botton 56. Secured to the bellows 57 is a small air tube 59 which extends from the mounting base 1 and its cover 2 to a suitable location for hand operation. The extremity of the tube 59 is provided with a squeeze bulb 60. The squeeze bulb may be arranged for hand operation or may be positioned for foot operation, and may be provided with a tab loop 60*a* if intended for hand operation, so that it may be supported by a suitable hook or convenient fastener, not shown.

If the warm water supply kit is intended for use as a bidet, a bidet nozzle unit 71 is provided which includes a mounting member 72 adapted to be secured to a toilet seat 73 shown in FIG. 8 and 9. The mounting member is secured under the back side of the toilet seat and includes a bore 74 of small diameter joined to a counter bore 75 having a key groove. The counter bore receives a bidet nozzle member 76 having a key rib 77 so as to orient the nozzle member 76 in the correct position within the counter bore. The nozzle member is provided with an upwardly and forwardly directed nozzle 78. A tube 79 is connected to the nozzle member 76 and extends therefrom into the housing formed by the mounting base 1 and cover 2 for connection to the outlet of the anti-syphon valve 5.

Referring to FIG. 1, water is introduced into the inlet 12 of the pressure regulator and shut-off valve 3 flows therethrough to the outlet 13 and is carried by a tube 80 to the inlet 37*a* provided in the sealing disk 37, water discharges from the outlet 37*b* and is connected by a tube 81 to the inlet of the anti-syphon valve 5 for delivery to the connecting tube 79.

Operation of the warm water supply kit as used in conjunction with the bidet nozzle unit 71 is as follows:

As installed, the minor heating element of the heater 4 remains on continuously except as controlled by the thermostat 40 which turns the heater element off when the temperature of the water rises to a predetermined value. When discharge of water from the bidet nozzle unit 71 is required, the squeeze bulb 60 is compressed causing the bellows 57 to extend and engage the push button 56. Closure of the switch activates the main heating element except as controlled by the thermostat 40 and opens the shut-off valve 33 permitting flow through the ring 19 through the tube 80 and into the heater 4. The heated water then flows through the anti-syphon valve 5 and through the tube 79 to the bidet nozzle member 76. Release of the squeeze bulb 60 opens the control switch 6 shutting off the flow of water.

The tubes 79 and 59 are formed of plastic material and may extend several feet from the wall mounted kit so that the danger of electric shock is eliminated.

The water pressure at the bidet nozzle member 76 is controlled by the set screw 26 which may be provided with a convenient knob 26*a* disposed externally of the kit.

Attention is directed to FIGS. 10, 11 and 12 which illustrate an ear washing unit 82 which may be joined by a connecting tube 79 to the warm water supply kit. The ear washing unit includes a mounting disk 83 having a small stem 84 and removable extension 85 dimensioned to fit freely within the vestibule of the ear. The extension 85 may be provided with a swirl tip 86 forming essentially tangential discharge slots 87 to produce a swirling motion of the water or in some cases may be omitted. The mounting disk 83 which is substantially larger than the vestibule may be provided with a tapered ear shell 88 adapted to close the entrance end of the ear vestibule. The mounting disk is also provided with a drain line 89.

In use, the extension 85 is inserted into the ear vestibule and the shell 88 is pressed against the walls of the opening thereto to provide a sealing connection. The squeeze bulb 60 is then operated to cause closure of the switch 6 and produce a warm stream of water delivered through the connecting tube 79. The water after circulation within the vestibule discharges into the shell 88 and into the drain line 89.

Having fully described our invention it is to be understood that we are not to be limited to the details herein set forth, but that our invention is of the full scope of the appended claims.

We claim:

1. A bidet water supply kit, comprising:

a. a mounting base for installation on an essentially vertical surface;

b. a valve structure mounted on said base and including: a shut-off valve chamber having an inlet connected to a water supply line and an outlet forming a pressure regulator valve seat; a solenoid having a plunger carrying a shut-off valve element normally engageable with the inlet; a valve element for the pressure regulator valve seat: a pressure regulator diaphragm; an adjustment screw and spring for adjusting the diaphragm; and an outlet;

c. a heater unit mounted on said base and including: an inlet connected to the outlet of the valve structure: a normally on, low rate heating element and a normally off, high rate heating element therein: a thermostat control for both heating elements; and an outlet;

d. an anti-syphon valve mounted on said base and having an inlet connected to the heater unit outlet, and an outlet connected to a discharge line, said discharge line comprising a tube of plastic material extending from said base to a location remote therefrom, said anti-syphon valve having a chamber communicating with said inlet and outlet and an anti-syphon opening, a valve member held by pressure in said chamber in position to close said opening and movable, in the absence of pressure in said chamber, to open said opening and close said inelt;

e. a bidet device secured to the underside of a toilet seat at said remote location and including: an inlet connected to the discharge line; and a discharge nozzle directed upwardly and forwardly from the toilet seat;

f. a control switch mounted on said base for the valve structure solenoid and the main heating element;

g. and a pneumatic actuator for operating the control switch, the pneumatic actuator including: a bellows mounted on said base and positioned to engage the control switch thereby to open the valve structure for flow of water to the bidet nozzle, and to energize the main heating element: a tube of plastic material extending from the bellows and from said base to another location remote therefrom and a manually operated squeeze bulb at the end of said last-named tube for activating the bellows.

* * * * *